US005215029A

United States Patent [19]

Davis

[11] Patent Number: 5,215,029

[45] Date of Patent: Jun. 1, 1993

[54] HYDROPLANING BOAT ACCESSORY

[76] Inventor: McKay H. Davis, 665 Browning Ave., Salt Lake City, Utah 84105

[21] Appl. No.: 888,567

[22] Filed: May 22, 1992

[51] Int. Cl.[5] ..... B63B 1/20

[52] U.S. Cl. ..... 114/274; 114/285; 114/362

[58] Field of Search ..... 114/285, 286, 287, 362, 114/274

[56] References Cited

U.S. PATENT DOCUMENTS

| | | | |
|---|---|---|---|
| 2,779,302 | 1/1957 | Atkinson | 114/285 |
| 2,928,365 | 1/1958 | Moon | 114/145 |
| 3,117,547 | 1/1964 | Cohen et al. | 114/285 |
| 3,515,087 | 6/1970 | Stuart | 114/286 |
| 3,601,078 | 8/1971 | Bedford | 114/285 |
| 3,602,178 | 8/1971 | White | 114/285 |
| 3,613,137 | 10/1971 | Eccles | 114/362 |
| 3,738,301 | 11/1971 | Sjoo | 114/287 |
| 4,323,027 | 4/1982 | Schermerhorn | 114/285 |
| 4,519,336 | 5/1985 | Mason | 114/286 |
| 4,548,155 | 10/1985 | Hegg et al. | 114/362 |
| 5,048,449 | 9/1991 | Templeman | 114/274 |

FOREIGN PATENT DOCUMENTS

| | | | |
|---|---|---|---|
| 163089 | 7/1986 | Japan | 114/285 |

OTHER PUBLICATIONS

Article entitled "Stern Drive Performance", Trim Tabs and Hydrofoils, published in Hot Boat magazine, publication date unknown.

Article entitled "Seamanship, Boathandling with Trim Tabs and Hydrofoils", published in Boating World magazine, publication date unknown.

*Primary Examiner*—Sherman Basinger
*Assistant Examiner*—Thomas J. Brahan
*Attorney, Agent, or Firm*—Lynn G. Foster

[57] ABSTRACT

A permanently fixed metal trim tab for attachment in pair combinations to the aft end of a boat. Each trim tab comprising a downwardly extending aft edge. A top surface of each trim tab comprises an aft area which comprises striations which provide an anti-slip surface. The strength, position of attachment to the boat, and anti-slip surface permit use of the trim tab as a step for entry and exit to and from the boat. Each trim tab comprises a flange for attachment to a transom of the boat from connecting points above and below an aftwardly extending substantially flat plate of the trim tab which is an integral part of the flange. The trim tab comprises a uniform cross section which is compatible with fabrication by an extrusion process.

13 Claims, 1 Drawing Sheet

HYDROPLANING BOAT ACCESSORY

FIELD OF INVENTION

This invention relates to accessories for hydroplaning boats and more particularly to aft disposed accessories which improve boat operation and provide for safe and easy aft access to the boat.

BACKGROUND AND DESCRIPTION OF RELATED ART

It has long been known that boat operation can be improved by adding a pair of trim tabs to opposing sides of the stern of the boat as performance improvement devices. Such devices generally provide augmenting lift as effective hull bottom extensions to primarily level the boat fore and aft. Trim tabs, attached to the boat, aid in lifting the stern of the boat, thereby dropping the bow and consequently assisting the boat in getting to a planing orientation more quickly and with lower expenditure of fuel. Correctly designed and set trim tabs also stabilize the boat in pitch and roll.

The exact origin of trim tabs is unknown, however it is known that early trim tabs comprised pieces of wood or shingles attached to a hull bottom to extend aft of the transom of the boat. Modern hull extending trim tabs are usually attached to the transom. Such trim tabs most often consist of pairs of plates or planes of steel, aluminum or plastic rigidly mounted or hinged at or near the bottom edge of the transom. Some models are permanently fixed and are stationary relative to the transom. Other models are mechanically adjustable.

Adjustable models are usually more expensive than permanently fixed, stationary models. Such adjustable models generally comprise a flat plate hinged to the transom above the bottom of the boat and operated by a hydraulic cylinder or threaded screw actuator. Examples of adjustable devices are found in U.S. Pat. Nos. 3,062,178 and 2,928,365. A deflectable plastic trim tab is disclosed in U.S. Pat. No. 3,601,078.

Permanently fixed trim tabs generally comprise no moving parts. An example of a permanently fixed trim tab is disclosed in U.S. Pat. No. 4,323,027 which teaches a plastic trim tab made by vacuum forming. To provide a structure capable of withstanding forces associated with hydroplaning acceleration and high boat velocity, the plastic trim tab comprises a pair of side edges and a pair of more medially disposed semitubular gussets which are seen as raised and depressed structures, on the top and bottom surfaces, respectively, of the plastic trim tab. The semitubular surfaces provide strengthening gussets for the plastic trim tab and direct water in increased velocity streams toward a downwardly curved aft end portion thereof. Consistent with vacuum forming, an upwardly formed mounting plate provides a single mounting flange for the plastic trim tab.

Flexing of plastic trim tabs during use often results in premature fracture breaking mounting flanges away from water contacting surface components. In the cases of both the fixed and adjustable trim tabs, while the trim tabs generally rest in the water at a convenient level for use as a step, no trim tabs are currently known which comprise the strength or form for use in providing safe and efficacious entry and exit into and from the boat.

BRIEF SUMMARY AND OBJECTS OF THE INVENTION

In brief summary, this novel invention alleviates all of the known problems related to making and using a low-cost, permanently fixed metal trim tab. The metal trim tab is long lasting and not subject to breakage or destructive action of corrosion or other environmental degradation, even after years of use. Also, the metal trim tab serves a second useful purpose as an anti-slip step for easy entry and access into a boat.

The trim tab comprises a mounting plate which has a top and a bottom mounting flange for secure and safe mounting to a transom of the boat. Extending outward from a centrally disposed line along the length of the mounting flange is a combination trim and step plate. The trim and step plate comprises a generally transversely planar bottom surface which is disposed at an angle relative to the mounting plate. The angle of the bottom surface, in combination with a downwardly curved trailing edge portion of the bottom surface, causes the mounting plate to bite into the water before the boat planes to increase effective lift at the stern of the boat and to be withdrawn from the water as the boat planes to reduce water imposed drag. The trailing edge portion of the bottom surface comprises a concave curved, substantially smooth and linear surface which, when disposed in the water behind a moving boat, results in greater pressures and therefore greater lift being exerted upon the trim tab.

A top surface of the trim and step plate is juxtaposed the bottom surface and extends outward from the mounting plate, somewhat tracing the path of the bottom surface. However, the top surface defines a path which diminishes the thickness of the trim and step plate as the two surfaces extend from the mounting flange to reduce weight of the trim tab while retaining sufficient strength for safe, long term use as both a trim tab and a step. Disposed on the trailing edge portion of the top surface over approximately one-half of the area thereof is a series of striations such that the trim tab can function as a safe, water bearing anti-slip step. In one embodiment, the striations and curvature of the trim tab are so formed that the trim tab is formed as part of a metal extrusion.

Accordingly, it is a primary object to provide a rigid metal trim tab for a boat comprising a downwardly curved trailing edge.

It is another primary object to provide a strong and substantial trim tab for the boat which serves as a useful aft positioned, anti-slip step.

It is still another primary object to provide a pair of long-lasting, rigid metal trim tabs which substantially decrease the time and energy required to bring a boat to a planing orientation.

It is another object to provide a trim tap which is essentially lifted from water contact when the boat planes.

It is an important object to provide a trim tab which is produced by an extrusion process.

It is another important object to provide a trim tab which attaches to a transom of a boat above and below a plane of a trim and step plate.

It is another basic object to provide a trim tab across which water flows in a substantially even or constant flow rate.

It is another basic object to provide a trim tab comprising top and bottom trim and step plate surfaces which define a trim tab of narrowing thickness toward the aft portion of the trim tab to conserve material from which the trim tab is made.

It is another object to provide a trim tab which also operates as an anti-slip step and which is made from a substantially corrode resisting material such as aluminum.

These and other objects and features of the present invention will be apparent from the detailed description taken with reference to accompanying drawings.

DETAILED DESCRIPTION OF THE ILLUSTRATED EMBODIMENTS

Figure 1:
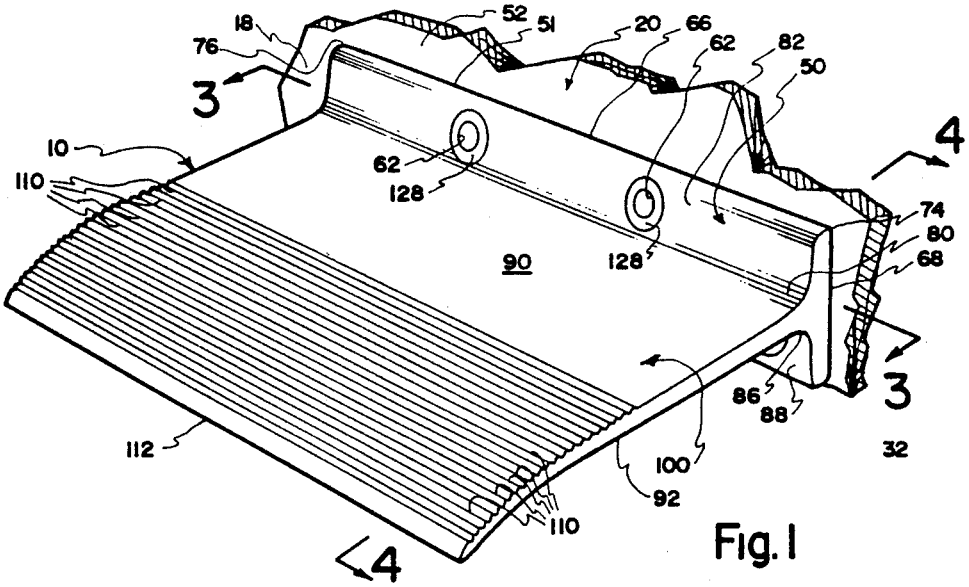
FIG. 1 is a perspective of a trim tab juxtaposed a portion of a transom of a boat.
Figure 2:
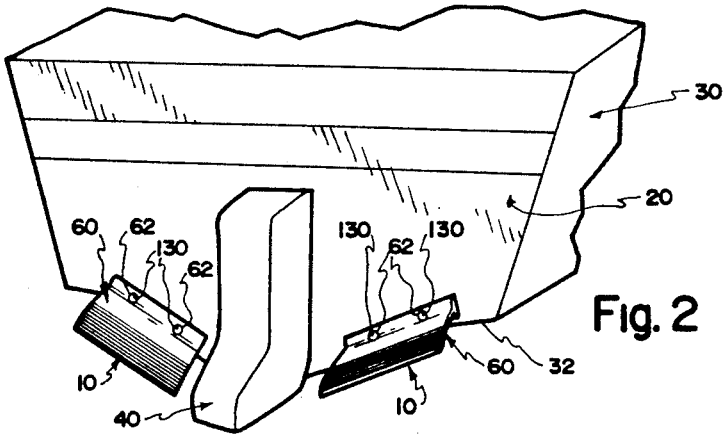
FIG. 2 is a perspective of a stern of the boat with two trim tabs attached to the transom thereof.

In this description, the term proximal is used to indicate the segment of the device normally closest to the object of the sentence describing its position. The term distal refers to the other end. Reference is now made to the embodiments illustrated in FIGS. 1–4 wherein like numerals are used to designate like parts throughout. As seen in FIG. 1, the system comprises at least one trim tab 10 connected to a portion 18 of a transom 20. As seen in FIG. 2, transom 20 is disposed at the stern of a boat 30. In FIG. 2, a pair of trim tabs 10 are seen to be connected in the vicinity of a hull bottom 32 of boat 30 on opposite sides of a motor housing 40.

Figure 3:
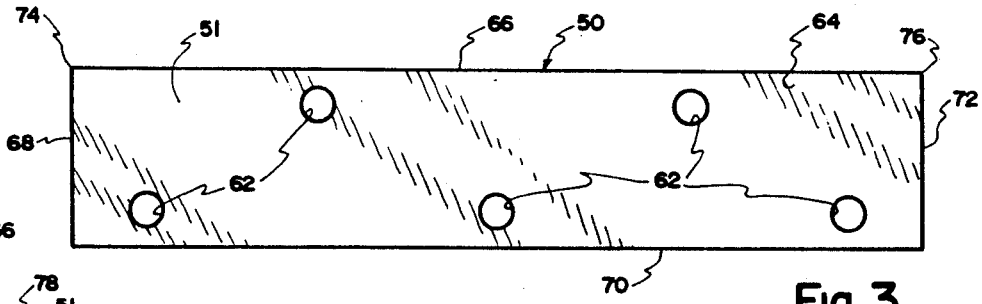
FIG. 3 is a side elevational view taken along lines 3—3 of FIG. 1.

Referring again to FIG. 1, trim tab 10 comprises a mounting flange 50 having a surface 51 juxtaposed and directly associated with an aft surface 52 portion of transom 20 when affixed to boat 30. A boat side view of surface 51 of flange 50 is seen in FIG. 3. As seen therein, flange 50 comprises a plurality of holes 62 used for mounting trim tab 10 to boat 30 with nuts and bolts, although a number of other structures such as brackets, slots, and clamps could be used for such attachment within the scope of the invention. As seen in FIGS. 1 and 3, rear surface 51 is substantially rectangular and is bounded by edges 66, 68, 70, and 72 counterclockwise seriatim. A corner 74 joins edge 66 to edge 68, and a corner 76 joins edge 72 to edge 66.

Figure 4:
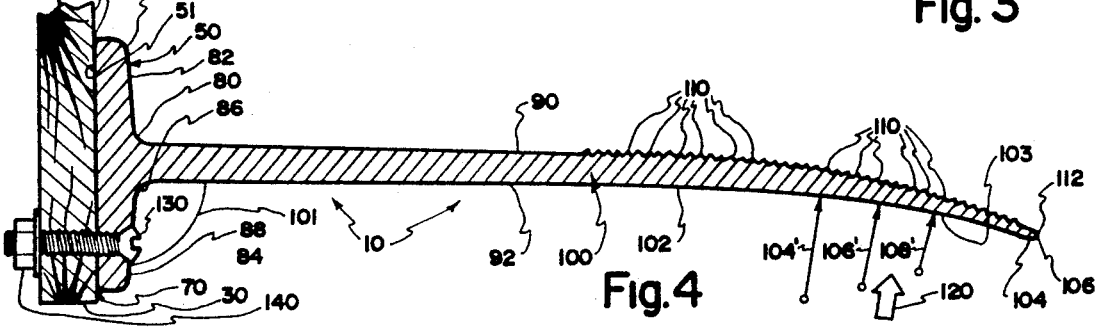
FIG. 4 is a cross section taken along lines 4—4 of FIG. 1.

Being of uniform cross section, trim tab 10 is best described in reference to FIG. 4. As seen therein, flange 50 is essentially rectangular in cross section. From edge 66, flange 50 extends aft to edge 78 and turns vertically downward to a reinforcing gusset 80 thereby defining aft surface 82. Similarly, from edge 70, flange 50 extends aft to edge 84 and upward therefrom to another reinforcing gusset 86 to define surface 88.

As seen in FIG. 4, trim tab 10 comprises an aft extending plate 100 which is integrally connected to flange 50. Plate 100 comprises a top surface 90 and a bottom surface 92.

Bottom surface 92 is connected to and continuous with surface 88 at gusset 86 forming an angle 101, therewith. From gusset 86, bottom surface 92 extends distally from flange 50 in a substantially straight line direction to a point 102 where bottom surface 92 begins to smoothly curve downward forming a concave bend 103 between point 102 and a bottom surface endpoint edge 104. Increase in curvature as bottom surface 92 extends toward edge 104 is indicated by a decrease in sequentially measured radii of curvature 104', 106', and 108'. From endpoint edge 104, bottom surface merges with top surface 90 at end segment 106.

Top surface 90 is connected to and continuous with surface 82 at gusset 80. From gusset 80, top surface 90 extends distally from flange 50 along a path similar to but not parallel to surface 92. In general, surface 90 is tilted slightly more to the vertical than surface 92, thereby diminishing the thickness of plate 100 from a thickest section interposed between gussets 80 and 86 to a narrowest section at section 106, the aft end of plate 100.

Approximately one-half of surface 90 comprises a plurality of striations 110 disposed on the aft side of surface 90. Striations 110 in combination expose an anti-slip surface when trim tab 10 is used as a step. The requirements of depth and separation of the striations to make anti-slip surfaces are well known in the marine step making art. Top surface 90 comprises an aftmost edge 112 which connects to segment 106 to complete the periphery of the FIG. 4 cross section of trim tab 10.

The dimensions of trim tab 10 can be varied widely within the scope of the invention. However, using one embodiment as an example, the thickness of flange 50 is approximately 0.250 inches. The thickness of plate 100 just aft from gussets 80 and 86 is approximately 0.250 inches and the thickness of plate 100 decreases essentially uniformly to approximately 0.0625 inches in cross section at edge 104. Radii of curvature 104', 106', 108' uniformly decrease to a smallest radius of curvature 108' which is approximately 5 inches.

As mentioned earlier, surface 92, and therefore plate 100, forms an angle 101 with flange 50 surface 88. In combination, the concavity of bending of surface 92 and the magnitude of angle 101 in large amount determine the trimming "bite" of trim tab 10. In this presently described embodiment, angle 101 is between 86 and 88 degrees. At 88 degrees, the horizontal level of end segment 106 is essentially the same as edge 70 when trim tab 10 is attached to a vertically disposed transom 20.

The combination of angle 101 being less than 90 degrees and the downwardly bending curvature of bottom surface 92 provides a trim tab which is mountable by flanges on both sides of plate 100 and yet which effectively and efficiently makes contact with water rising from the aft of boat 30 during preplaning acceleration of boat 30. When boat 30 reaches planing orientation, trim tab 10 is essentially withdrawn from the water, eliminating water caused drag thereby. Further, as bottom surface 92 presents a substantially transverse straight line surface to water coursing therebelow, the characteristic water flow relative to bottom surface 92 is uniform and relatively smooth or laminar. Upward lift is provided thereby in the direction of arrow 120 (see FIG. 4) against plate 100. At the same time, relatively lower drag is experienced than would otherwise be encountered by a trim tab which generates more turbulent flow.

As mentioned earlier, the uniformity of cross section of trim tab 10 is compatible with metal extrusion processes which are widely known and used in the art. In the embodiment of the example given above, extrusions are produced in lengths of ten to thirty feet and are cut into trim tab 10 lengths ranging from eleven to fifteen inches. As one of ordinary skill in the art would understand, these lengths are exemplary and applicable to boats ranging in length from ten feet to thirty feet long, respectively, although other trim tab 10 lengths could be used as determined by boat design and desired performance criteria. The metal used in the embodiment described in the example is aluminum, although other metals which are compatible with water use and have the strength for use as both a step and trim tab can be used. After cutting each trim tab 10 to length and deburring the cut, holes are drilled into flange 50 in the pattern and form of holes 62 seen in FIGS. 3 and 1.

Referring once more to FIG. 3, flange 50 is seen to comprise a plurality of holes 62, comprising two holes 62 superiorly placed above the plane of plate 100 and three holes 62 inferiorly placed to the plane of plate 100, although other patterns of holes and attachments may be made within the scope of the invention. Placing holes 62 above and below the plane of plate 100 provides a force distributing attachment pattern for forces emanating from below (trimming forces) and from above (step forces) on transom 20. The width of flange 50 as determined by the lengths of edges 68 and 72 and the distance between holes 62 is determined to provide support for at least four hundred pounds distributed across trim tab 10 in either direction. As seen in FIG. 1, each hole 62 comprises a bevelled edge 128 which permits flush mounting of a bolt 130 (see FIG. 4) when disposed therein for attachment of trim tab 1 to transom 20.

Attachment of trim tab 10 to each transom 20 is made both above and below the plane of plate 100. Holes matching the pattern of holes 62 in surface 51 are drilled through transom 20. Trim tab 10 is positioned such that a bolt 130 inserted therethrough and anchored by a nut 140 (again see FIG. 4) firmly secures trim tab 10 to transom 20. In some cases, transom 20 should be reinforced to withstand forces exerted by each trim tab 10 as is well understood by one of ordinary skill in the art. In the example provided above, stainless steel socket head bolts and special grip bolt anchors with mounting flange gaskets are used in the mounting process.

As mentioned earlier, the angulation between flange 50 and bottom surface 92 in combination with the concavity of bend 103 permits the bottom edge of flange 50 to be mounted above the bottom of boat 30 and still provide effective disposition of trim tab 10 for use in trimming and as a step. As seen in FIGS. 1 and 2, each trim tab 10 is mounted such that the bottom edge 70 of flange 50 is at or above hull bottom 32.

The invention may be embodied in other specific forms without departing from the spirit or essential characteristics thereof. The present and exemplary embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A rigid metal trim tab comprising:

a rigid mounting flange whereby the trim tab is immovably attached to a transom of a boat;

an aft extending substantially rigid cantilevered metal plate integrally and rigidly connected at a proximal end of the metal plate to the mounting flange, the metal plate extending outward from the flange and comprising a cantilevered proximal portion disposed within a linear plane, the cantilevered proximal portion comprising an essentially linear bottom surface, and a curved cantilevered distal portion, the curved cantilevered distal portion being an extension of the cantilevered proximal portion, the linear cantilevered proximal portion and the curved cantilevered portion being static and position-retaining during use, the curved cantilevered distal portion comprising a fixed position concave bottom surface which extends outwardly and downwardly thereof and a top surface, the last mentioned concave bottom surface and top surface merging at a distal tip.

2. The rigid metal trim tab according to claim 1 wherein the top surface of the distal portion is convex and substantially follows the curvature of the bottom surface of the distal portion the distal portion defining a substantially thin wall section of the metal plate when compared to the thickness of the metal plate at the site where the proximal portion is joined with the mounting flange.

3. The rigid metal trim tab according to claim 1 wherein the mounting flange comprises at least one portion above the top surface of proximal portion of the rigid metal plate and at least a second portion below the bottom surface of the rigid metal plate.

4. The rigid metal trim tab according to claim 3 wherein each said of the two mounting flange portions comprises holes used in attaching the trim tab to the transom.

5. The rigid metal trim tab according to claim 1 wherein said top surface of the distal portion comprises anti-slip means to provide user stability when the top surface is used as a step.

6. The rigid metal trim tab according to claim 1 wherein said plate and said flange, in combination, comprise at least one mutual non-orthogonal angle.

7. The rigid metal trim tab according to claim 6 wherein said mutual angle is inferior to said bottom surface and comprises an angle between eighty and eighty-nine degrees.

8. The rigid metal trim tab according to claim 7 wherein said trim tab comprises an aft edge which is raised substantially out of the water when the boat planes as a consequence of the magnitude of the mutual angle and the bend in combination.

9. The rigid metal trim tab according to claim 1 wherein said concave bend in said bottom surface comprises a minimum radius between four and six inches.

10. A rigid metal trim tab comprising:

a mounting flange whereby the trim tab is attached to a transom of a boat;

an aft extending substantially rigid metal plate integrally affixed and joined as a single piece with and extending outward from the flange, said plate comprising a transversely linear bottom surface comprising a concave bend disposed at the aft end of the plate and having a transverse longitudinal axis parallel with the flange and further comprising a transversely linear top surface which comprises a convex bend to conformably deflect relative to the bottom surface to adjoin to the bottom surface at the aft end of the trim tab;

said top surface comprising a step which is integral with said rigid metal plate and which comprises anti-slip serrations.

11. The rigid metal trim tab according to claim 10 being fabricated from a single metal extrusion comprising said flange, said top and bottom surfaces with said respective convex and concave bends, and said serrations.

12. A rigid metal trim tab comprising:

a mounting flange whereby the trim tab is immovably and non-deflecting attached in a generally vertically extending orientation to a transom of a boat;

an aft extending substantially rigid metal trim tab plate integrally joined as a single piece in substantially non-deflecting, rigid generally perpendicular relationship to and extending rearwardly from the flange and boat, said trim tab plate comprising a bottom surface comprising a generally linear proximal segment and a concave bend distal segment and a top surface which comprises a generally linear proximal segment and a convex bend distal segment;

the distal segment of the top surface comprising step means.

13. A method for producing a metal trim tab and anti-slip step and attaching the trim tab to a boat comprising the steps of:

extruding a one piece metal section from which the trim tab is made so that the extruded section being substantially longer than the trim tab and comprising a boat attaching flange, aft extending trim tab plate top and bottom surfaces with respective convex and concave bends at the distal ends thereof, and serrations disposed upon the top surface at least at the distal end thereof, to facilitate use as a step;

cutting a length from the extruded section which conforms to a predetermined tab size;

fabricating at least one mounting hole in the flange of the cut length to form the trim tab;

securely affixing the flange of the trim tab to the boat through the use of the at least one mounting hole.

* * * * *